US009555862B1

(12) United States Patent
Sutherland

(10) Patent No.: US 9,555,862 B1
(45) Date of Patent: Jan. 31, 2017

(54) ROTATABLE BOAT RAIL

(71) Applicant: Johnny Sutherland, Calvert City, KY (US)

(72) Inventor: Johnny Sutherland, Calvert City, KY (US)

( * ) Notice: Subject to any disclaimer, the term of this patent is extended or adjusted under 35 U.S.C. 154(b) by 0 days.

(21) Appl. No.: 14/804,722

(22) Filed: Jul. 21, 2015

Related U.S. Application Data

(60) Provisional application No. 62/026,924, filed on Jul. 21, 2014.

(51) Int. Cl.

| | |
|---|---|
| ***B63B 29/04*** | (2006.01) |
| ***B63B 27/00*** | (2006.01) |
| ***B63B 17/04*** | (2006.01) |
| *A47C 7/62* | (2006.01) |

(52) U.S. Cl.
CPC ..... *B63B 27/00* (2013.01); *B63B 17/04* (2013.01); *B63B 29/04* (2013.01); *A47C 7/62* (2013.01); *B63B 2029/043* (2013.01)

(58) Field of Classification Search
CPC ..... A01K 97/10; A47C 7/66; A47C 7/62; B63B 27/00; B63B 17/04; B63B 2017/045; B63B 29/04; B63B 2029/043; B63B 29/06
See application file for complete search history.

(56) References Cited

U.S. PATENT DOCUMENTS

| | | | | | |
|---|---|---|---|---|---|
| 4,645,167 | A * | 2/1987 | Hardwick | B63B 29/04 | 248/283.1 |
| 5,000,412 | A * | 3/1991 | Sheehan | A01K 97/06 | 248/286.1 |
| D399,367 | S * | 10/1998 | Sieland | A01K 97/10 | D22/147 |
| 5,987,804 | A * | 11/1999 | Shearer | A01K 97/10 | 43/21.2 |
| 6,681,517 | B1 * | 1/2004 | Solomon | A01K 97/10 | 43/21.2 |
| 2006/0272688 | A1 * | 12/2006 | McWhorter | A45B 11/00 | 135/16 |
| 2014/0203600 | A1 * | 7/2014 | Rushing | A47C 7/62 | 297/188.21 |

* cited by examiner

*Primary Examiner* — Andrew Polay
(74) *Attorney, Agent, or Firm* — C. Brandon Browning; Maynard, Cooper & Gale, PC

(57) ABSTRACT

A rotatable boat rail and method of making and using same, the rail including a cylinder defining a passageway and a generally L-shaped member having a horizontal section and a vertical section coupled to the cylinder member such that a proximal end of the L-shaped member extends radially outward from a lower end of the cylinder. The horizontal section of the L-shaped member is arranged essentially perpendicular to the cylinder and the vertical section is arranged essentially parallel to the cylinder. In use, a seat on a boat seat stand is removed from the stand and the stand is inserted through the cylinder passageway so that the cylinder is rotatably supported on the stand and the vertical section of the L-shaped section extends upwardly. The seat is then re-attached to the top of the stand. In use, a person requiring support when exiting or entering the boat, can grasp the L-shaped member and apply pressure against the boat rail for steadying the person.

15 Claims, 4 Drawing Sheets

ROTATABLE BOAT RAIL

RELATED APPLICATION

This application claims priority to U.S. Provisional Application No. 62/026,924, filed on Jul. 21, 2014 and titled "Rotatable Boat Rail," the entire contents of which are incorporated herein by reference.

FIELD OF INVENTION

The present invention relates to a rail device for assisting users with entry onto and off a boat. More particularly, the present invention relates to a vertically extending rail that is rotatably coupled to boat seat stand that can be used for assisting a user with entry on to and off of the boat and providing a stable support when walking about the boat and boat seat.

BACKGROUND OF THE INVENTION

Getting onto or off of a small boat can be dangerous since small boats are prone to tilting or even flipping over when a user moves about the boat. When a boat tilts a person on the boat is likely to lose balance and fall. To address this problem many boats include substantially horizontal rails that are rigidly fixed to the hull of the boat. However, in may instance such rails are raised only a short distance above the hull and do not provide support to standing, upright persons. Often, these rails do not extend higher since doing so would create a horizontal barrier over which a person attempting to enter or exit the boat may not be able to overcome.

SUMMARY OF INVENTION

The present invention is directed to a rotatable boat rail apparatus and methods of making and using same. According to one aspect of the invention, there is provided a boat rail apparatus including a cylinder member defining a passageway, the cylinder member having an upper end and a lower end. A generally L-shaped member having a proximal end, a distal end, a horizontal section and a vertical section is coupled to the cylinder member such that the proximal end of the L-shaped member extends radially outward from the lower end of the cylinder. The horizontal section of the L-shaped member is arranged essentially perpendicular to the cylinder and the vertical section is arranged essentially parallel to the cylinder. A support member extends to and between a midsection of the horizontal section and the upper end of the cylinder for bracing the L-shaped member against the cylinder. A loop is provided at the distal end of the L-shaped member.

To assemble the boat rail with a boat, a seat on a boat seat stand is removed from the stand exposing the top of the stand. The upper end of the stand is inserted through the lower end of the cylinder so that the cylinder is rotatably supported on the stand and the vertical section of the L-shaped section extends upwardly. The seat is then reattached to the top of the stand.

In use, a person requiring support when exiting or entering the boat, can grasp the loop and apply pressure against the boat rail for steadying the person. When the person is on the boat, the person can use the boat rail for support when walking about or near the boat rail stand. Because the boat rail stand is rotatably 360 degrees about the boat seat stand, the person can rely on the rail no matter on what side of the boat seat the person is or desires to be.

According to another aspect of the invention there is provided a rotatable boat rail system including a boat having a seat supported above a floor by a pedestal, a cylinder defining a passageway, the pedestal being inserted through the passageway and the cylinder being rotatable about the cylinder, and a shaft supported by the cylinder and extending from the cylinder radially outward and away from the floor. A support beam or bracket extends to and between the cylinder and the shaft for providing strength and rigidity to the shaft.

The shaft has an upper end that is located at a greater distance above the floor than a top surface of the seat. This distance provides a sufficient height for the shaft so that a user can lean upon the shaft or place the user's body weight on the shaft while remaining standing and upright. When the seat includes a seat back, the upper end may extend above a top surface of the seat back. To assist with grasping the shaft, a handle may be provided at the upper end, for example, in the form of a loop.

According to another aspect of the invention there is provided a method of supporting a person on a boat. The method includes providing a boat having a seat supported above a floor by a pedestal and rotatably coupling a shaft to the pedestal, the shaft extending radially outward from the pedestal and away from the floor. A user grasps the shaft and rotates an upper end of the shaft at least partially around the seat while walking beside the seat. As needed, the user exerts a portion of the user's body weight on the shaft when walking beside the seat.

According to yet another aspect of the invention there is provided a method of making a rotatable boat rail. The method includes providing a rail including a cylinder defining a passageway and a shaft supported by and extending radially outward from the cylinder, removing a seat from a boat, the seat being supported above a floor by a pedestal, and inserting the pedestal through the passageway and thereby rotatably coupling the rail to the pedestal. The shaft is arranged to extend upwardly and away from the floor so that the shaft has an upper end located at a greater distance above the floor than a top surface of the seat. Thereafter, the seat is operably coupled back to the pedestal. The boat rail may be constructed of a metal, a metal alloy or a rigid plastic such as PVC.

DETAILED DESCRIPTION OF PRESENTLY PREFERRED EMBODIMENTS

Figure 1:
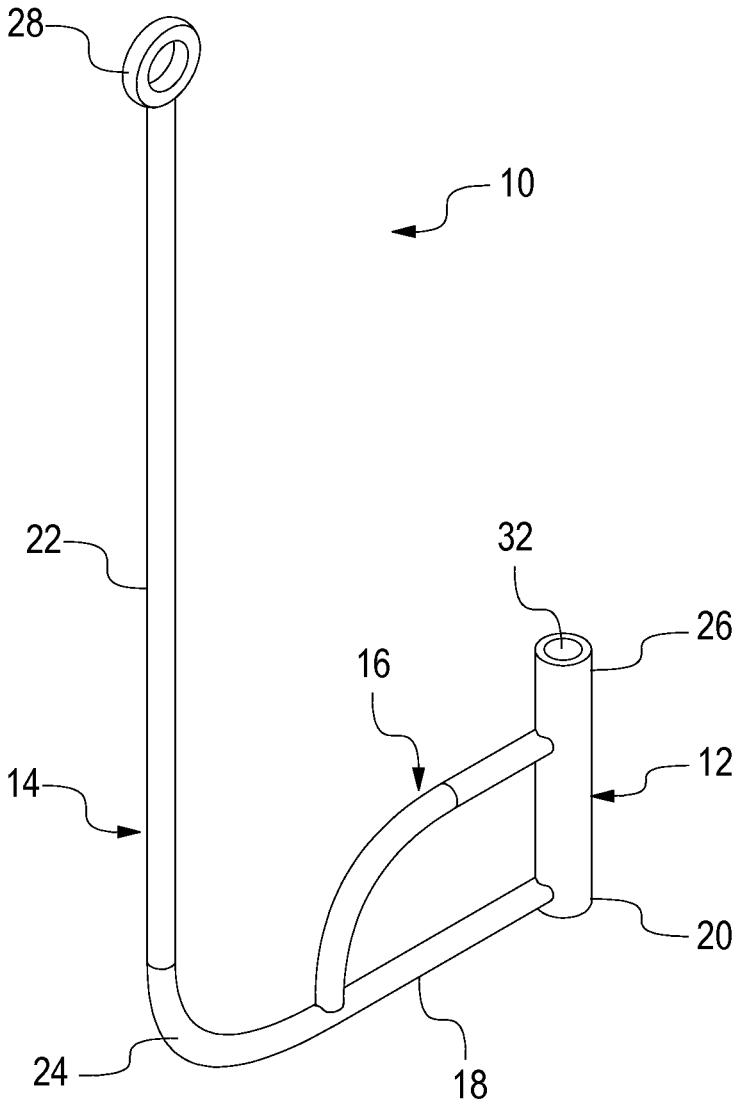
FIG. 1 is a perspective view of a rotatable boat rail in accordance with the present invention.
Figure 3:
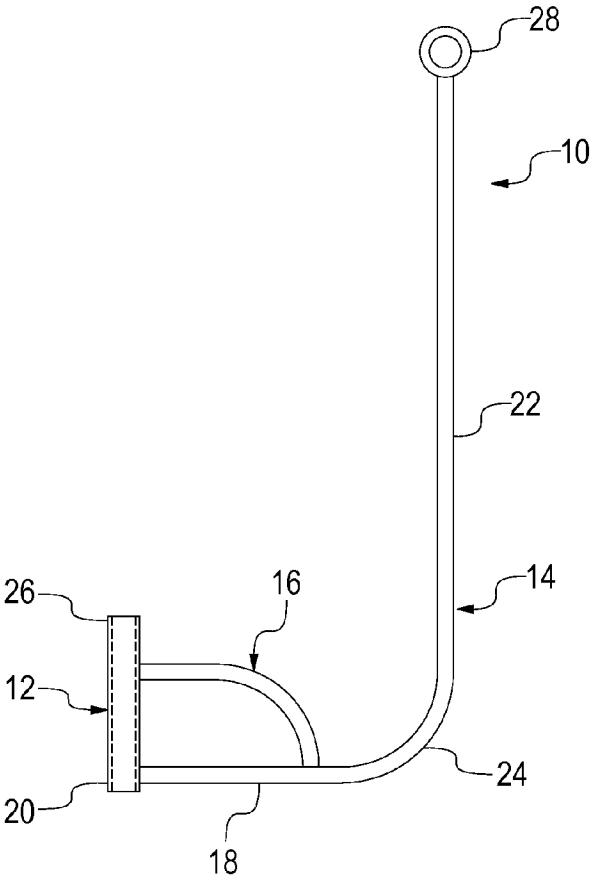
FIG. 3 is an elevation view of a second side of the boat rail of FIG. 1.
Figure 2:
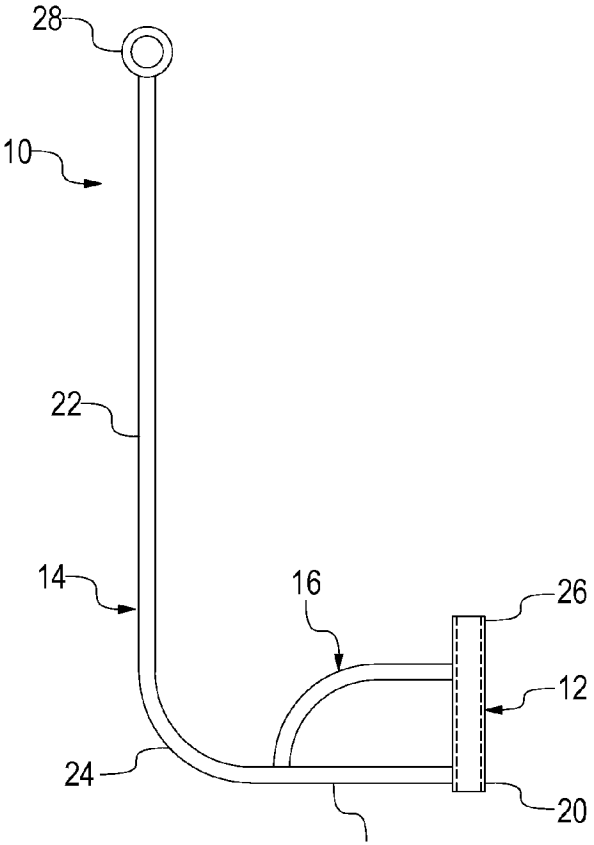
FIG. 2 is an elevational view of a first side of the boat rail of FIG. 1.

Referring to FIGS. 1 through 3, there is depicted a boat rail 10 in accordance with the present invention. Boat rail 10 generally includes a cylinder 12, an L-shaped shaft 14 coupled to cylinder 12 and a beam 16 that serves to brace shaft 14 against cylinder 12 thereby giving strength and rigidity to rail 10.

More particularly, shaft 14 includes a first portion 18 that extends radially and perpendicularly out from a lower section 20 of cylinder 12 and a second portion 22 that extends parallel to cylinder 12. A curved portion 24 couples first portion 18 to second portion 22. Beam 16 extends radially out and perpendicularly from an upper section 26 of cylinder 12 and curves downward towards first portion 18 of shaft 14. Beam 16 is essentially coplanar with curved portion 24, first portion 18 and second portion 22 of shaft 14. A handle portion 28 is provided at the free end of second portion 22 of shaft 14. Handle portion 28 is preferably a closed loop.

Figure 5:
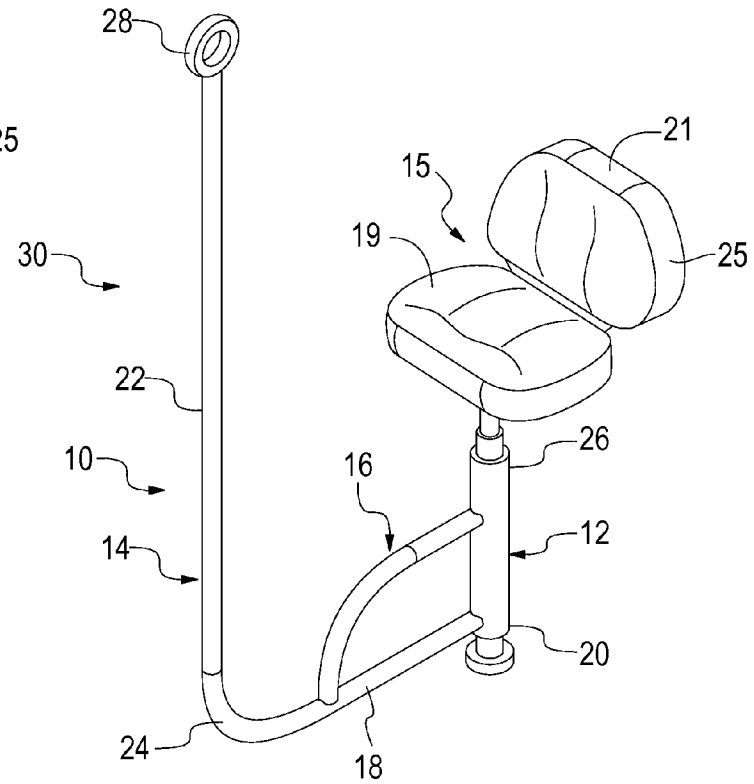
FIG. 5 is a perspective view of the boat rail system of FIG. 4.
Figure 4:
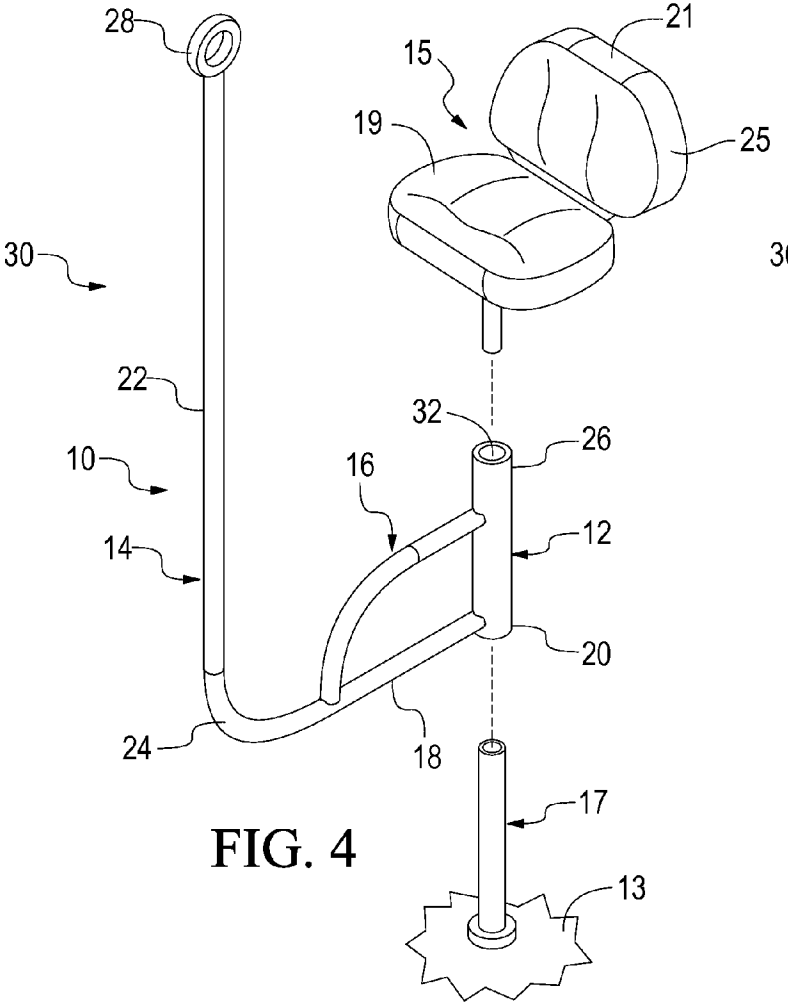
FIG. 4 is an exploded perspective view of a boat rail system including the boat rail of FIG. 1.

Referring to FIGS. 4 and 5, there is depicted a boat rail system 30 including boat rail 10 installed in a boat 11 having a floor 13, a boat seat 15 and a boat seat pedestal 17 for supporting seat 15 above floor 13 a desired distance. In particular, cylinder 12 of rail 10 defines an internal passageway 32 through which pedestal 17 is inserted after removal of seat 15 from pedestal 17. A lower edge 34 of cylinder 12 is rotatably supported on a flange 36 extending radially out from the exterior surface of cylinder 36. Seat 15 is then reattached to pedestal 17.

With rail 10 rotatably supported on pedestal 17 in this manner, shaft 14 extends from cylinder 12 radially outward and away from floor 13 with handle portion 28 of shaft 14 being located a distance above floor 13 sufficient to allow a user to grasp handle portion 28 while remaining standing and upright. Thus, handle portion 28 should be at least as high as a top surface 19 of seat 15. Handle portion 28 may also be at least as high as a top surface 21 of a seat back 25, when seat 15 includes a back. This height ensures that a user can grasp handle portion 28 and rotate handle portion 28 completely around seat back 23 when walking around seat 15 without seat back 23 interfering with the user's arm.

Figure 6:
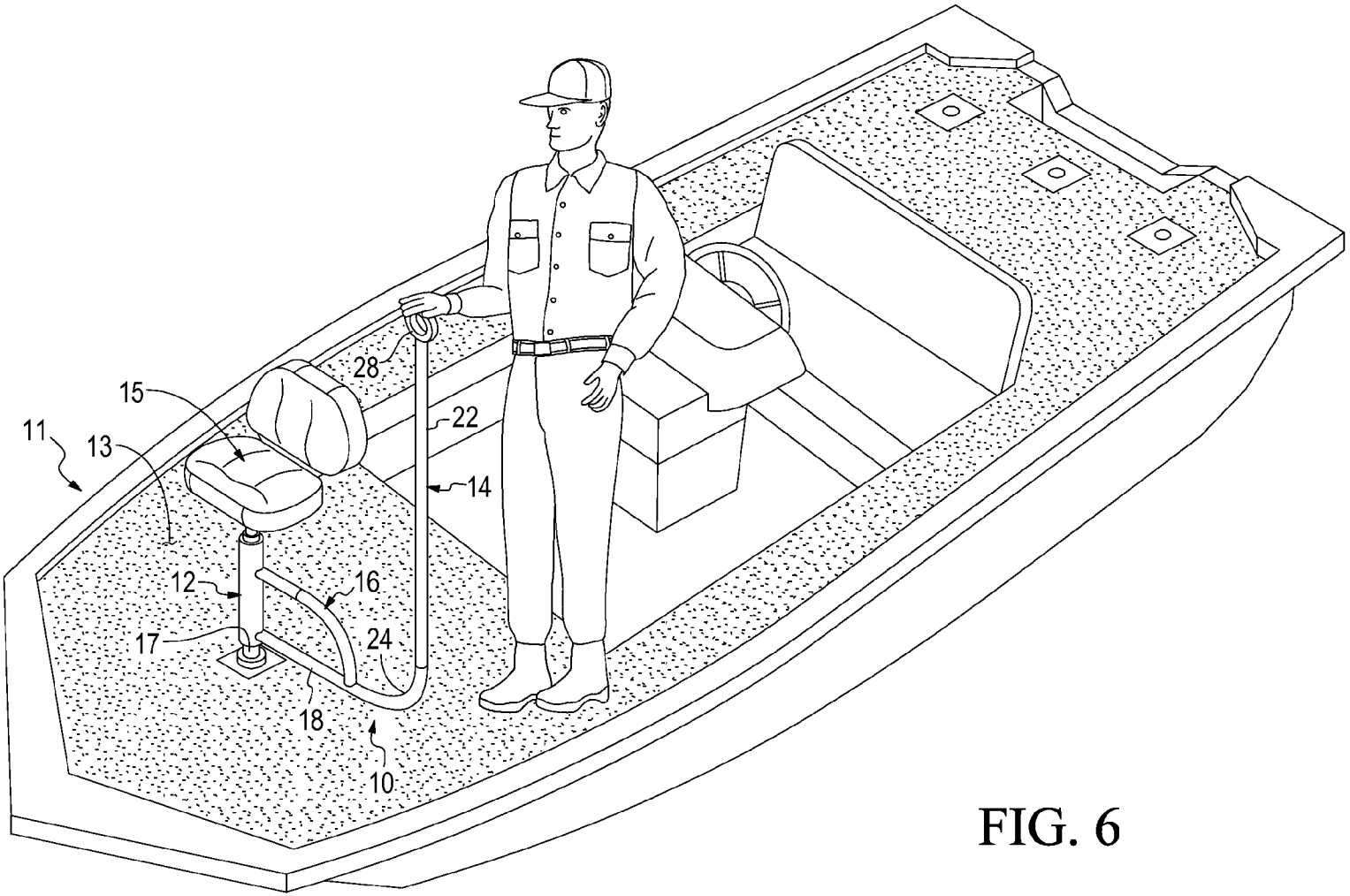
FIG. 6 is a perspective view of a person making use of the boat rail system of FIG. 4.

Referring to FIG. 6, there is depicted a person making use of rail 10 on boat 11. In particular, a person desiring to enter upon, exit from or walk upon boat 11, grasps handle portion 28 with a user's hand and rotates an upper end of shaft 14 at least partially around seat 15 as required while the user walks beside seat 15. When necessary, the person exerts a portion of the person's body weight on shaft 14 when walking beside seat 15. Since haft 14 can be rotated completely around seat 15, the person can make use of rail 10 continuously while walking completely around seat 15.

References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

The various methods and embodiments described herein are exemplary and are not intended to limit the interpretation of this disclosure. Various other methods and embodiments for the boat rail and manufacture thereof are possible.

It is claimed:

1. A rotatable boat rail apparatus comprising:

a boat having a seat supported above a floor by a pedestal, a cylinder defining a passageway, the pedestal being inserted through the passageway and the cylinder being rotatable about the pedestal, a shaft supported by the cylinder and extending from the cylinder radially outward and away from the floor, the shaft having an upper end, and a support beam extending to and between the cylinder and the shaft, wherein the upper end is located at a greater distance above the floor than a top surface of the seat.

2. The apparatus of claim 1 wherein the seat includes a seat back, the upper end being located at a greater distance above the floor than a top surface of the seat back.

3. The apparatus of claim 1 wherein the upper end includes a closed loop.

4. The apparatus of claim 1 wherein the shaft is substantially L-shaped.

5. The apparatus of claim 1 wherein the shaft includes a first portion that extends parallel to the pedestal.

6. The apparatus of claim 2 wherein the shaft includes a second portion that extends perpendicular to the pedestal.

7. The apparatus of claim 1 wherein the upper end is rotatable completely around the seat.

8. The apparatus of claim 1 wherein the support beam extends to and between an upper section of the cylinder and the shaft.

9. The apparatus according to claim 8 wherein the support beam extends to an upright portion of the shaft.

10. A method of making a rotatable boat rail comprising:

providing a rail including a cylinder defining a passageway and a shaft supported by and extending radially outward from the cylinder, arranging a support beam between the cylinder and the shaft, removing a seat from a boat, the seat being supported above a floor by a pedestal, inserting the pedestal through the passageway and thereby rotatably coupling the rail to the pedestal, and arranging the shaft to extend upwardly and away from the floor so that the shaft has an upper end that is located at a greater distance above the floor than a top surface of the seat.

11. The method of claim 10 including operably coupling the seat to an upper end of the pedestal.

12. The method of claim 10 including arranging the upper end to be located at a greater distance above the floor than a top surface of a seat back that is coupled to the seat.

13. The method of claim 10 including arranging the shaft to have a first portion extending perpendicular to the pedestal and a second portion extending parallel to the pedestal.

14. The method of claim 10 including arranging a lower edge of the cylinder to be above the floor.

15. The method of claim 10 including arranging a lower edge of the cylinder to rest upon a flange extending radially out from the pedestal.

* * * * *